US008601928B2

(12) United States Patent
Martinez et al.

(10) Patent No.: US 8,601,928 B2
(45) Date of Patent: Dec. 10, 2013

(54) RESTRAINT DEVICE FOR USE IN AN AQUATIC ENVIRONMENT

(75) Inventors: Martin A. Martinez, Phoenix, AZ (US); Patrick Barnhill, Phoenix, AZ (US); Steven A. Floyd, Petaluma, CA (US)

(73) Assignee: Engineering Science Analysis Corp., Tempe, AZ (US)

( * ) Notice: Subject to any disclaimer, the term of this patent is extended or adjusted under 35 U.S.C. 154(b) by 536 days.

(21) Appl. No.: 12/839,930

(22) Filed: Jul. 20, 2010

(65) Prior Publication Data

US 2011/0005374 A1 Jan. 13, 2011

Related U.S. Application Data

(63) Continuation-in-part of application No. 12/185,947, filed on Aug. 5, 2008, now Pat. No. 7,882,775.

(60) Provisional application No. 60/963,927, filed on Aug. 7, 2007.

(51) Int. Cl.
*B63B 13/00* (2006.01)

(52) U.S. Cl.
USPC ..... 89/1.34; 114/317; 114/382; 89/1.11

(58) Field of Classification Search
USPC ..... 89/1.11, 1.34; 86/50; 188/8, 4 R; 102/402, 403, 406, 409, 502, 503, 504, 102/399; 404/6; 144/316, 317, 319; 114/382
See application file for complete search history.

(56) References Cited

U.S. PATENT DOCUMENTS

| | | | | |
|---|---|---|---|---|
| 229,058 | A * | 6/1880 | Spencer | 89/1.34 |
| 1,217,415 | A | 2/1917 | Colomyjczuk | |
| 3,496,580 | A * | 2/1970 | Gulmon | 441/85 |
| 3,505,926 | A * | 4/1970 | Johnson | 89/1.34 |
| 4,253,132 | A | 2/1981 | Cover | |
| 4,712,479 | A | 12/1987 | Babel | |
| 5,345,874 | A | 9/1994 | Lemonnier et al. | |
| 5,396,830 | A | 3/1995 | Kornblith et al. | |
| 5,762,443 | A | 6/1998 | Gelfand et al. | |
| 5,811,713 | A | 9/1998 | Gudgel | |
| 5,921,704 | A | 7/1999 | Pacholok et al. | |
| 5,936,183 | A | 8/1999 | McNulty, Sr. | |
| 6,269,726 | B1 | 8/2001 | McNulty, Sr. | |
| 6,312,188 | B1 | 11/2001 | Ousterhout et al. | |
| 6,312,189 | B1 | 11/2001 | Marphethia | |
| 6,381,894 | B1 | 5/2002 | Murphy | |
| 6,553,912 | B2 | 4/2003 | Wygant | |
| 6,623,205 | B1 | 9/2003 | Ramirez | |
| 6,854,374 | B1 | 2/2005 | Breazeale | |
| 7,032,530 | B1 * | 4/2006 | Ansay et al. | 114/319 |

(Continued)

OTHER PUBLICATIONS

National Institute of Justice, "Department of Defense Non-lethal Weapons and Equipment Review: A Research Guide for Civil Law Enforcement and Corrections," Oct. 2004, NCJ205293.

(Continued)

*Primary Examiner* — Michael Carone
*Assistant Examiner* — Reginald Tillman, Jr.
(74) *Attorney, Agent, or Firm* — Douglas W. Rudy

(57) ABSTRACT

A method and device for impeding the progress of a swimmer or a diver included a plurality of tendrils that can be launched into the path of a target and entangle the target.

7 Claims, 11 Drawing Sheets

(56) References Cited

U.S. PATENT DOCUMENTS

| | | | | |
|---|---|---|---|---|
| 7,056,054 | B1 | 6/2006 | Keith et al. | |
| 7,201,531 | B2 | 4/2007 | Shackelford et al. | |
| 7,210,875 | B1 | 5/2007 | Christle et al. | |
| 7,220,076 | B2 | 5/2007 | Boll | |
| 7,275,889 | B1 | 10/2007 | Mc Gill | |
| 7,314,007 | B2 | 1/2008 | Su | |
| 7,398,617 | B2 | 7/2008 | Mattox | |
| 7,640,839 | B2 | 1/2010 | McNulty, Jr. | |
| 2003/0051652 | A1* | 3/2003 | Metherell et al. | 114/241 |
| 2005/0016372 | A1* | 1/2005 | Kilvert | 89/1.34 |
| 2006/0048665 | A1* | 3/2006 | Kilvert | 102/406 |
| 2006/0140715 | A1 | 6/2006 | Lyddon et al. | |
| 2007/0017432 | A1* | 1/2007 | Farinella et al. | 114/382 |
| 2007/0264079 | A1 | 11/2007 | Martinez et al. | |
| 2007/0266883 | A1 | 11/2007 | Law et al. | |
| 2007/0283940 | A1* | 12/2007 | Lin | 124/59 |

OTHER PUBLICATIONS

Greg Lucas, "Bay Area's New Efforts in the War on Terror Coast Guard Weapon: High-tech net to keep boats from off-limits areas," San Francisco Chronicle Article, Aug. 10, 2005.

MIL-HDBK 5 "Military Handbook Metallic Materials and Elements for Aerospace Vehicle Structures," United States DOD, Dec. 1, 1998.

Honeywell Spectra Technical Bulletin, HON-PF-PS10.

Steven H. Scott, "Sticky Foam as a Less-Than-Lethal Technology," Sandia National Laboratory, US DOE Contract No. DE-AC04-96AL8500, CIRCA 1994.

T.D. Goolby and K.J. Padilla, "Sticky Foam Restraining Effectiveness Human Subject Tests for the Less-Than-Lethal Foam Project," Sandia Report, Jul. 8, 1994 UNCI.

MIL-HDBK 17 "Military Handbook Composite Materials Handbook," United States DOD, Dec. 12, 2002.

* cited by examiner

RESTRAINT DEVICE FOR USE IN AN AQUATIC ENVIRONMENT

CROSS REFERENCE TO RELATED APPLICATION

This application is a continuation-in-part of prior application Ser. No. 12/185,947, filed Aug. 5, 2008, which claims the benefit of provisional Application 60/963,927, filed Aug. 7, 2007. This application claims priority in previously filed provisional application 60/963,927, filed Aug. 7, 2007 and to non-provisional application Ser. No. 12/185,947, filed Aug. 5, 2008, both applications are hereby incorporated by reference in their entireties.

STATEMENT REGARDING FEDERALLY SPONSORED RESEARCH

Some elements of this invention may have been developed under Department of Homeland Security SBIR Contract NBCH060024.

BACKGROUND OF THE INVENTION

Field of the Invention

This invention is directed to a system, apparatus and method for the restraint of an aquatic vehicle, a person in an aquatic environment, or an animal in an aquatic environment through the use of an entanglement device that will entangle such vehicle, person or animal. It is primarily intended to restrain a swimmer or a diver who is trying to penetrate a protected zone surrounding a ship, a harbor or other restricted location. The entanglement device incorporates a plurality of tendrils and filaments, that are propelled from a housing by compressed gas, an explosive charge, a rocket based projectile or by pressure generated by a gas generator of the type commonly used in air bag deployment apparatus. Filaments that are launched from the device may be attached to projectiles, having a hydro-dynamic shape, that may carry adhesive substances, conductive elements, or barbed capture elements that will adhere, stick or hook onto to a target surface. The filaments are designed to entangle a target and restrain the targeted element. In various embodiments the projectiles and filaments could be of negative buoyancy, neutral buoyancy, or positive buoyancy.

This invention is also directed to a system, apparatus and method for the deterrent of a target through the use of a device that will deliver electric shocks to a target for repelling persons or animals. Projectiles may be projectiles, in one embodiment, frangible balls, carrying adhesive or conductive elements or barbed capture elements or a combination thereof that will adhere or stick to a target surface. Filaments may be included to deliver electric shocks to the target.

The primary intended application is to use the restraint device as a device floated on or under the water, in a single or in an array configuration in which the systems intelligently communicate ("net centric") to locate a target and activate the closest device to ensnare and disable the target. In another embodiment an array of multiple systems can be directed to swarm to and around a target. The devices, either above or below the surface of the water, may incorporate a propulsion device enabling the devices to be directed to a target and swarm around it.

The inventor also contemplates that the entanglement device, system and method can be used as a perimeter defense system to deter, restrain, or identify targets by marking with a trackable substance or device, for instance, a paint or fluorescent substance or an electronic tracking device.

In another embodiment the inventor contemplates that the entanglement device, system and method can be launched from a 'launch platform' such as a missile tube, torpedo launcher, sono-buoy launcher, pneumatic launcher, grenade launcher, mortar tube, or by other means, such as, but not limited to, a projectile, mortar, flying disc, remote controlled aircraft, shotgun shell, launched grenade or missile. Device can also be hand placed, dropped in place, from a ship, from a helicopter, or fixed wing aircraft. The device can also be carried as a payload on some other delivery system.

Thus the entanglement device, system and method can be placed or submerged at a variable depth. It can be configured as a sea-borne mine, sono-buoy, or similar aquatic compatible device. The devices can also be placed in position by an unmanned delivery system.

The inventors also contemplate attaching an electric shock delivery option, such as an electric shock element using electro muscular disruption or shaped pulse systems. Another option is incorporate an electrically conductive adhesive or other means to enhance the shock delivery mechanism.

DESCRIPTION OF RELATED ART

To reduce the complexity and length of the Detailed Specification, and to fully establish the state of the art in certain areas of technology, Applicants herein expressly incorporate by reference material identified in the following publications.

Greg Lucas, "Bay Area's New Efforts in the War on Terror Coast Guard Weapon: High-tech net to keep boats from off-limits areas," San Francisco Chronicle Article, Aug. 10, 2005. (Available on the Internet.).

Honeywell Spectra Technical Bulletin, HON-PF-PS10, (Available on the Internet).

Steven H. Scott, "Sticky Foam as a Less-Than-Lethal Technology," Sandia National Laboratory, US DOE Contract No DE-AC04-96AL8500, CIRCA 1994.

T. D. Goolby and K. J. Padilla, "Sticky Foam Restraining Effectiveness Human Subject Tests for the Less-Than-Lethal Foam Project," Sandia Report, Jul. 8, 1994 UNCI (Available on the Internet).

The applicants believe that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, an apparatus and a method for restraining, marking, deterring, or rendering inefficient an aquatic target such as a swimmer or diver. It may be used to restrain humans or animals depending on the designed application and embodiment taught by the general operating principles of the invention.

In one embodiment of the invention the activation hardware and the ensnaring elements are carried on or in a cylindrical housing.

The method of entangling, or otherwise engaging, a target may be accomplished by providing an entangling apparatus having a housing; a barrel, in some embodiments; a pressure generator; and a projectile, which may be a frangible ball in some embodiments; and attached tendrils. The entangling apparatus is positioned in an expected path of a target and armed for use. When a target swimmer or diver, whether human or animal, is proximate the entangling apparatus, pressure generation to launch the projectiles and tendrils is initiated. The pressurization will cause the launching of the projectile from the barrel of the entangling apparatus. The launched projectile will deploy as plurality of tendrils around the device. The swimmer or diver will, if proximate the tendrils, become entangled in the tendrils.

An object of the invention is to provide a device and method for entangling a swimmer or a diver.

It is an object of the invention to provide restraint or deterrent to restrain a person or an animal in an aquatic environment.

It is also an object of the invention to provide a non-lethal restraint device that can be deployed from a land-based, water-borne, or air-borne platform.

It is also an object of the invention to provide automatic arming and triggering systems for arming and discharging the device so that the device can perform with minimal user intervention.

It is also an object of the invention to provide an immobilization device that is compact, reloadable and reusable.

It is also an object to have an immobilization device that can be positioned by being dropped from an aircraft or deploying the device from a water borne vessel without damage to the device.

It is also an object of the invention to have a device that can be remotely armed from a safe distance from the expected path of a target.

Another object of the invention is to provide a method of entangling a target with a tendril using relative motion of the target and the tendril to effect entanglement.

Also an advantage of the invention is that it can be activated by a shock delivery mechanism. This is especially useful in a situation where a device is dropped from height into a body of water. The impact of the water on the device, in a collapsible chamber zone, will cause the device to deploy tendrils from the device.

The above and other objects may be achieved by providing non-lethal restraint system including a housing having an exterior surface and having a pressure manifold inboard of the exterior surface of the housing. The housing includes at least one barrel extending from the exterior of the housing to the pressure manifold and a pressure generator or stored source of pressure or compressed gas, such as, but not limited to a nitrogen bottle/cartridge carried in the pressure manifold. A projectile carried in the barrel has a spool, a tendril wound on the spool and a frangible ball or other projectile connected to the tendril. It is expected that a large number of barrels will be provided in each housing.

The immobilization apparatus will include a pressure generator carried in the housing and a set of barrels containing projectiles in communication through a manifold to the pressure generator. The apparatus includes a set of tendrils. Frangible balls or projectiles are attached to the leading end of the tendrils. An activation device, in communication with a pressure generator, is used to initiate the pressure generator.

The above and other objects may be achieved by using methods of entangling a target as set forth in this disclosure. The method may be accomplished by providing an entangling apparatus having a housing, a barrel, a pressure generator, and a projectile having a frangible ball or projectile and attached tendril. The entangling apparatus is then positioned, launched, or otherwise deployed in an expected path of a target. The apparatus can then be armed for firing. When a target is in the proximity of the entangling apparatus, pressure generation is initiated. That is the device is "fired." The pressurization will cause the launching of the projectile from the barrel of the entangling apparatus. The launched projectile will either contact the swimmer/diver target with the projectile, the frangible ball, or the tendril of the projectile causing entanglement of the target with the tendril of the projectile through relative motion of the target and the tendril or will position tendrils in the expected path of the swimmer or diver.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION OF THE INVENTION

In one application of the invention the aquatic restraint device will be positioned for use by placing the device in the expected pathway of a target swimmer or diver. Arming of the device can be performed by closing a switch on the housing or from a remote location. Once armed the device is ready for use. As the target swimmer or diver approaches the device the device will launch an array of projectiles and plurality of tendrils from the device. These tendrils will ensnare the target swimmer or diver.

Figure 1:
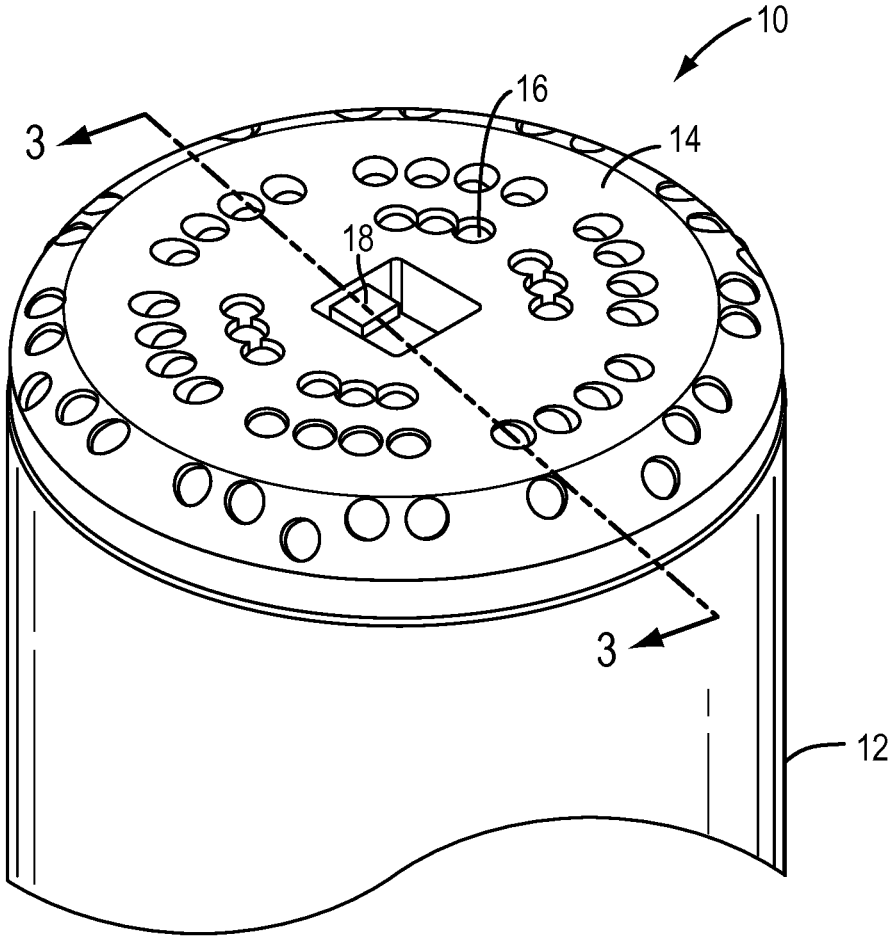
FIG. 1 depicts an embodiment of a cap element of an immobilization device.
Figure 6:
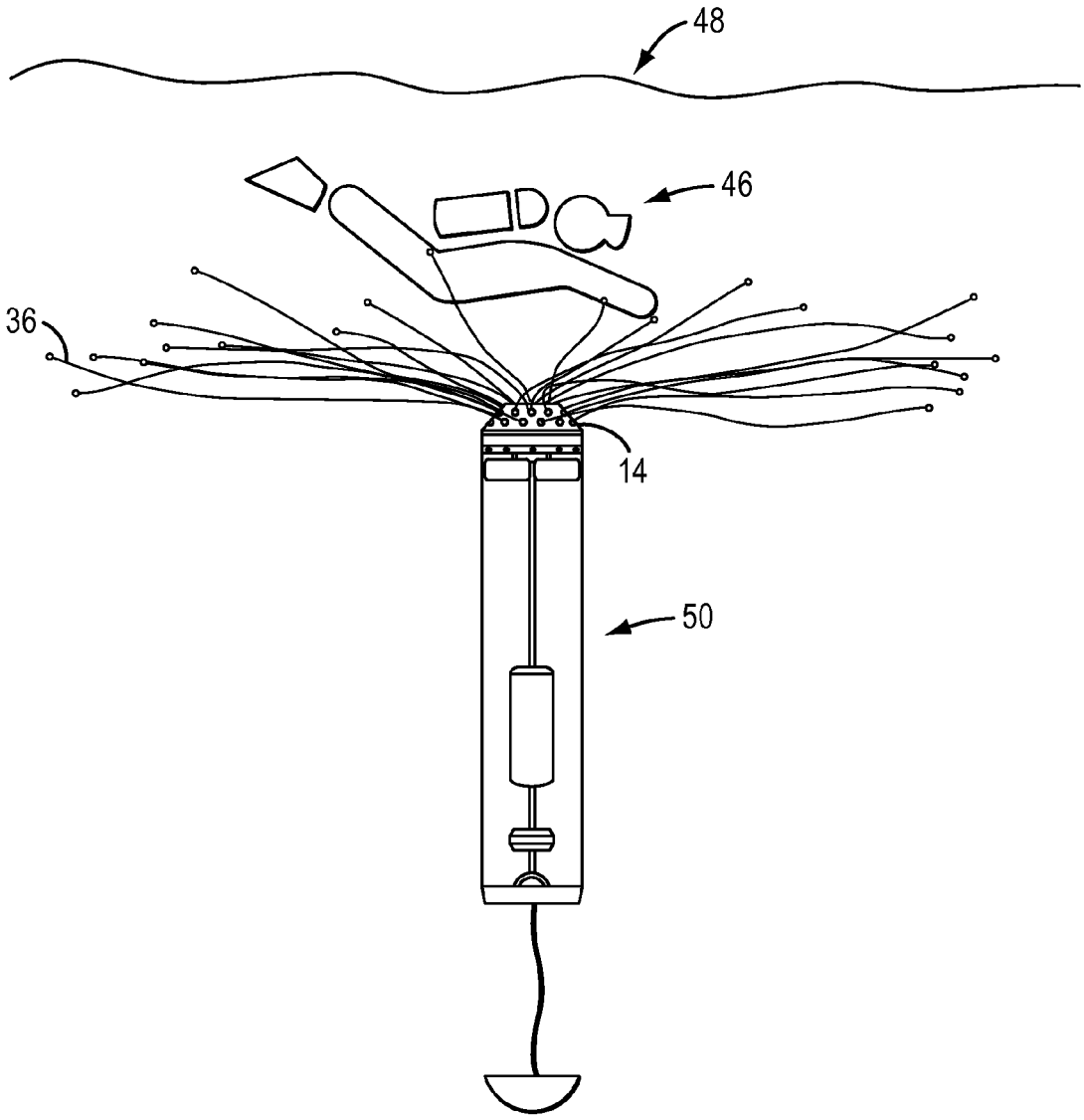
FIG. 6 is a pictorial representation of an entangling device having a portion removed to show the internal elements of the device, the entangling device for entangling a swimmer or a diver.
Figure 7:
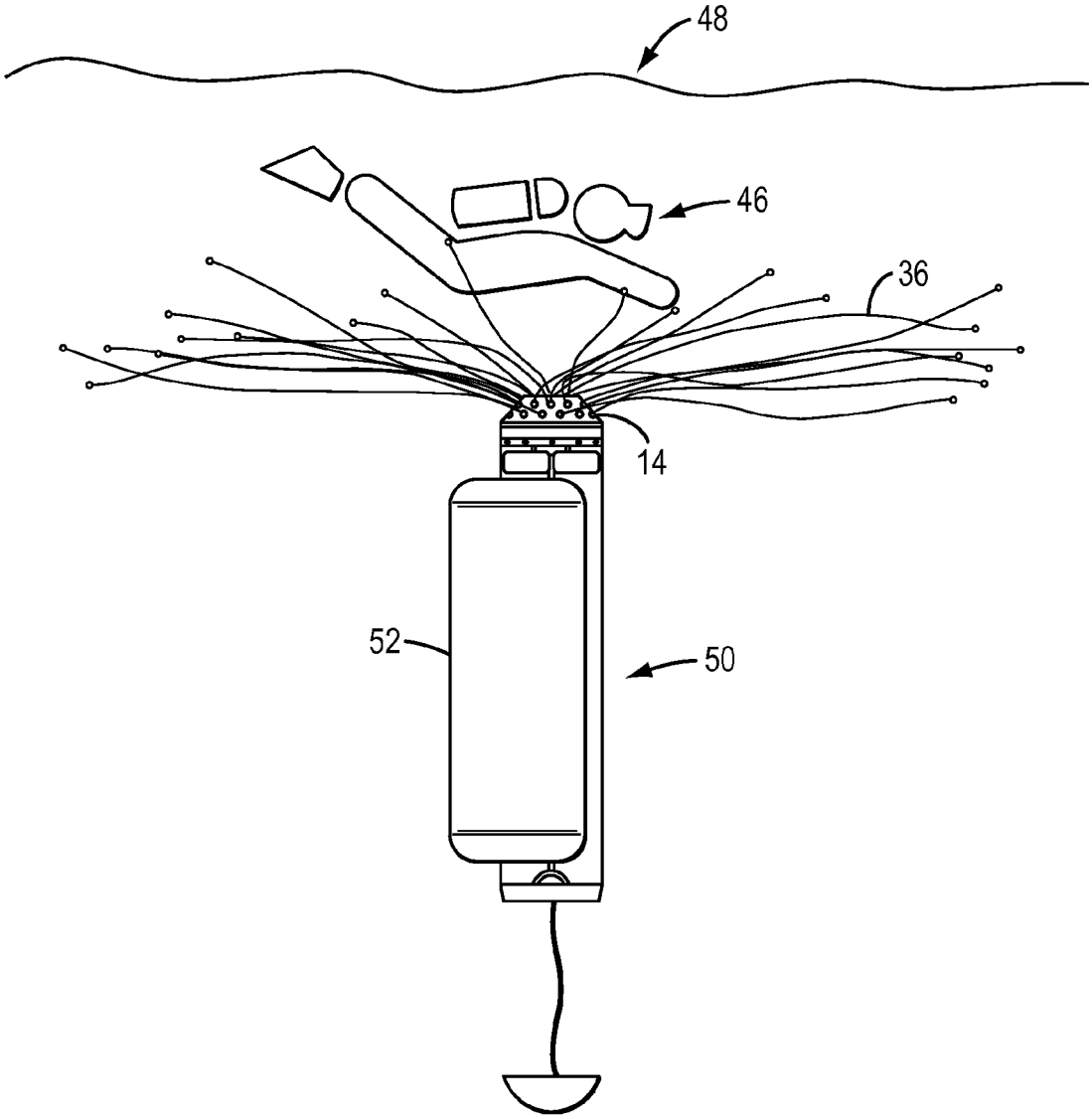
FIG. 7 is a pictorial representation of another embodiment of an entangling device having a portion removed to show the internal elements of the device and an inflatable structure to effect the buoyancy of the device, the entangling device for entangling a swimmer or a diver.
Figure 8:
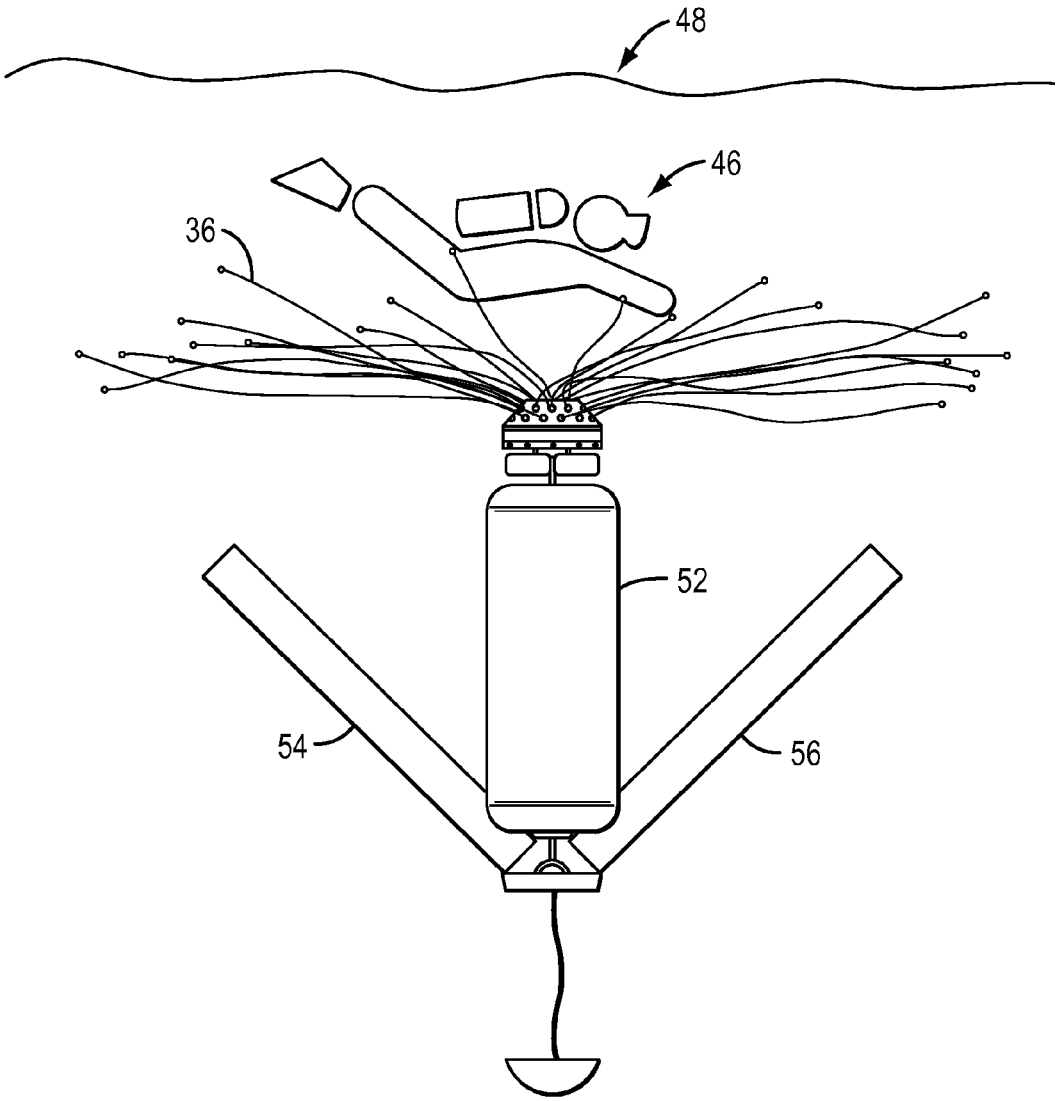
FIG. 8 is a pictorial representation of another embodiment of an entangling device having a portion removed to show the internal elements of the device and a pair of swing away housing elements attached to the device.

Turning first to FIG. 1, a swimmer and diver restraint device is shown, also shown in FIGS. 6, 7, and 8, with a portion of the subtending body broken away. The head portion of the swimmer or diver immobilization device is shown generally as item 10. The device includes a housing 12. At the upper end of the housing there is a head portion 14 with numerous barrels, such as 16, and a proximity detector and actuation device package 18. The housing 12 is sometimes referred to as the propulsion device in the description of embodiments presented herein.

Figure 2:
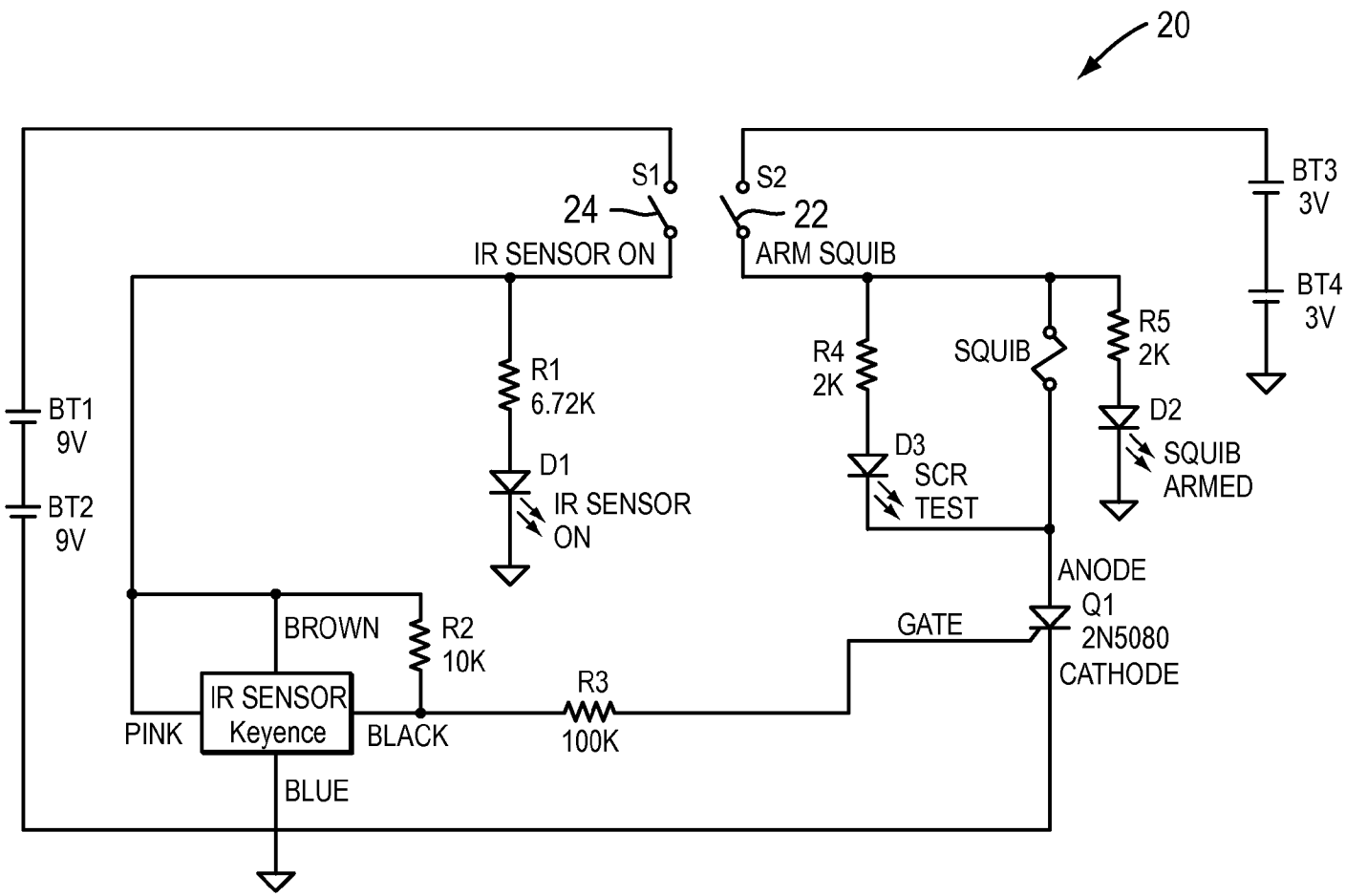
FIG. 2 is an schematic of the actuation circuit used to control the immobilization device shown in FIG. 1.

FIG. 2 is an electrical schematic of a triggering circuit, shown generally as item 20. This circuit includes a switch 22 to arm the immobilization device and a remote signal responsive switch 24. The switch 22 can be closed manually or remotely by an operator controlling the device.

Figure 3:
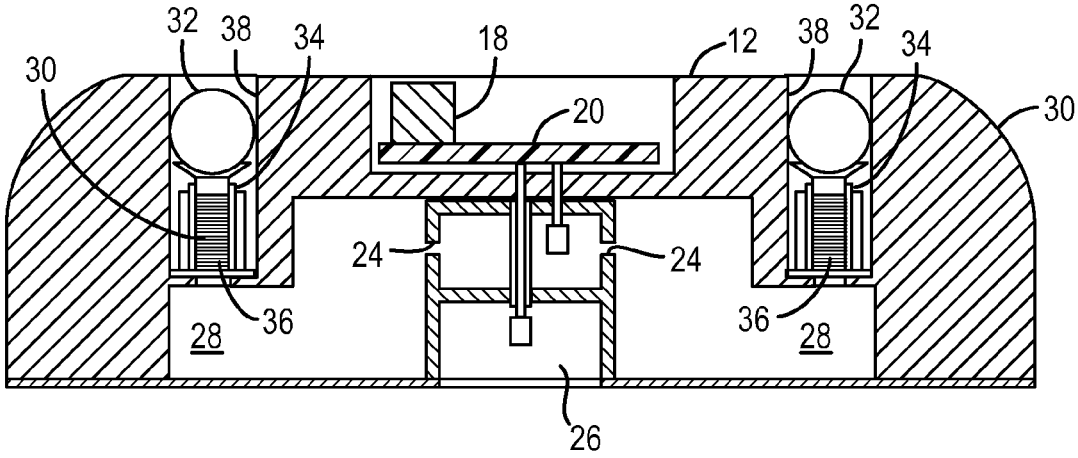
FIG. 3 is a cross sectional view of the head of the device through plane 3-3 of FIG. 1.

As shown in FIG. 3, the cross sectional view through plane 3-3 of FIG. 1, the head portion 14 of the housing 12 will contain a proximity and actuation device package that is in communication with the triggering circuit board 20. A gas generator chamber is electrically connected with the triggering circuit generally 20.

A set of ports, or pressure delivery conduits, such as 24, extend from the gas generator chamber 26 to a manifold 28. The manifold 28 provides communication to a plurality of percussion chambers 30, each associated with a projectile 32 and spool assembly 34 on which tendrils are wound. The tendrils 36 are attached at one end to the projectile 32 while the tail end of the tendrils are attached fixedly attached to the head of the device. The tendrils are strong filaments of line capable of significant tensile strength. The projectiles 32 are carried on a support having a surface on an extended portion of the support, the extended portion of the support on which the projectile is carried being a sliding fit in a projectile guide 38 of a launch chamber.

The projectiles shown in FIG. 3 communicate to the manifold 28 to be launched by gas pressure generated by the gas generator in the gas generator chamber 26. In another embodiment the pressure in the manifold 28 from the gas generator will be used to actuate a percussion or gas generating device carried in the projectile itself or the chamber hosting the projectile. The percussion device could be an explosive charge such as an explosive cartridge or a compressed gas device, either of which when actuated, is capable of launching individual projectiles such as plastic devices, rubber or rubber like devices, frangible balls, or metallic or non-metallic devices and the attached tendrils 36. The projectiles maybe hydro-dynamic in shape so that when the device launches the tendrils underwater, the projectiles will have to be streamlined enough to travel efficiently through the water.

The tendrils 36 are long tendrils and strong enough to entangle and hold a target swimmer or diver. Length of the tendrils can be longer or shorter than this to fit design criteria for a specific device. Once entangled with the swimmer or diver target the tendrils will restrain the swimmer or diver by entangling him in the numerous tendrils launched from the device.

The inventor has found that a gas generator of the type used in automotive airbag deployment systems that has been integrated into the device provides a good source of pressurized gas for deploying the tendrils.

Figure 4A:
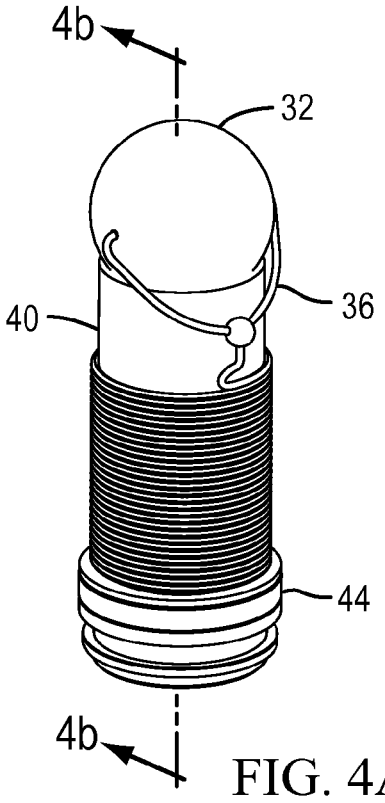
FIG. 4*a* is a representation of a launchable spool and projectile element.
Figure 4B:
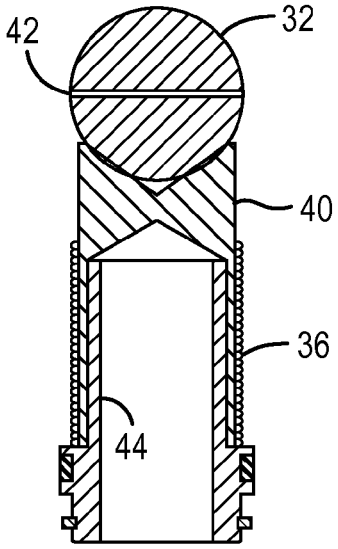
FIG. 4*b* is a cross sectional view through 3-3 of FIG. 4*a;*
Figure 5:
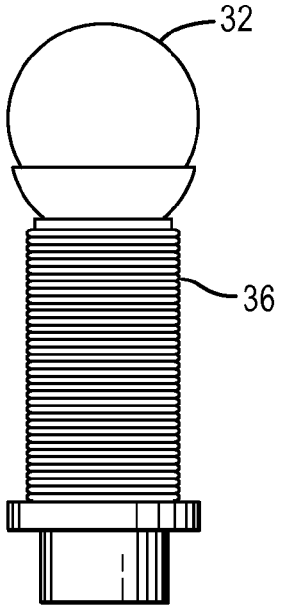
FIG. 5 is representation of the spool and projectile element used in FIG. 1.

FIGS. 4*a* and 4*b* show another embodiment of a projectile launch tube. The projectile 32 is attached to the tendril 36 wound on a launchable spool 40. When the projectile 32 is launched the projectile 32 will pull the tendril from the launchable spool 40. The projectile 32 may be a mass element, either a plastic, rubber or rubber like element, or it may be a frangible ball encapsulating an adhesive, a barb or hook element, or both, to assist entangling a target swimmer or diver.

FIG. 4*b* is a cross sectional view of FIG. 4*a*. In this view the projectile 32, having a through bore 42 is positioned on the launchable spool 40. The launchable spool 40 provides a storage location for the tendril 36. The tendril is wrapped around the launchable spool 40 in a way that will allow easy unspooling as the projectile 32 pulls the tendril 36 off the launchable spool 40. The second end of the tendril is attached to the housing of the device. In this configuration when the projectile 32 is launched the launchable spool will be launched off a hollow cylindrical base 44. Upon launch the base 44 remains with the launch propulsion device but the launchable spool 40, projectile 32 and tendril 36 will all be launched together. As the projectile 32 and launchable spool 40 travel in its launch path the tendril 36 will unwind from the spool and the spool will fall into the body of water where the device is deployed. It has been found that launching the launchable spool 40, having an elongated hollow body, from the base 44, which also has an elongated hollow body, provides directional stability over the launch of a projectile alone. This is because the tube-in-tube relationship shown in FIG. 4*b* acts as a barrel that elongates as the propulsion charge fills the interior cavity of the base 44 and the launchable spool 40. This provides almost double the length of the barrel and extends the time duration for improved stability and guidance during the launch of the projectile 32 as compared to a device that doesn't have a tube-in-tube configuration.

In operation the aquatic restraint device can be loaded with ballast to set the buoyancy of the device. As the ballast weight is adjusted, the depth that the aquatic restraint device floats partially above the surface of the water or below the surface of the water can be set or regulated.

In a situation where a restraint device is floating just below the water surface it may be desirable to raise the device above the surface of the water just before the tendrils are deployed. This can be done by having the device pop out of the water by releasing the ballast from the housing 12 while a long strap still attaches the ballast to the structure of the device. The cylindrical body will contain some air, so when the ballast is released, the cylindrical body, buoyed by the contained air, will be forced up by buoyancy. By sensing or timing when the head of the device is above the surface of the water, the head will launch the tendrils. In one embodiment this launching will occur at the precipice of the cylindrical body's ascent.

The device presented here is designed to entangle swimmers and divers. It can also be used to entangle animals, such as dolphins, porpoises and other trained or programmed animals or fish. FIG. 6 shows a diver generally 46 swimming below the surface, generally 48, of a body of water. A swimmer would normally be on the surface 48 of the body of water as is well known. The tendrils 36 would be floating on or near the surface of the water in the path of the swimmer. The diver 46 is shown in this figure over an underwater entangler generally 50 that has a plurality of tendrils, one of many tendrils shown as 36. The tendrils 36 will entangle the diver 46 and impede his progress through the water. He will be immobilized through the entanglement with the tendrils.

FIG. 7 is similar to the device shown in FIG. 6. In this embodiment there is the added element of a buoyancy bag or bladder 52. The buoyancy bag 52 is configured to be initially pressurized to float the underwater entangler 50 at a level below the surface of the body of water at a depth selected by the entangler setting team. In the case of using the entangler to impede swimmers the entangling device 50 may be located near or on the surface of the water. If it is primarily for impeding divers or animals the entangling device 50 may be located below the surface of the water.

FIG. 8 is similar to the device set forth in FIG. 7. Here the buoyancy bag 52 is obscuring the body of the entangler device. In this embodiment a pair of panels of the body of the device 54 and 56 are shown.

In one embodiment of the invention an inflatable balloon or floatation bladder is provided. It will be used to support a swimmer or bring a diver to the surface of a body of water after he is entangled in the tendrils of the device. A remotely operated switch, operated by an observer for instance, can inflate this balloon or they can be inflated automatically upon a sensing apparatus, such as but not limited to a sensor sensing tension on or pulling of the tendrils by an entangled swimmer or diver. The floatation bladders would enable an entangled swimmer or diver to be brought to the surface of the water upon the inflation of the floatation bladders where he or she would have a better access to air.

Figure 9:
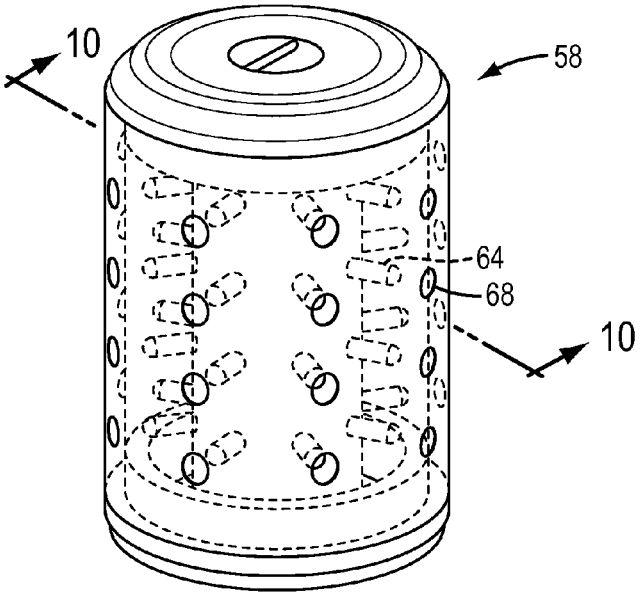
FIG. 9 is a container for housing a plurality of entangling elements.

FIG. 9 is a housing, generally 58, with some of the interior elements shown in broken line renderings. It is contemplated that a plurality of these housings will be carried on a line 60 so that a number of the housings can be deployed in a generally vertical column as shown. In this embodiment the head 62 is separated from the housing 58 by the line 60. The head 62 as well as each housing 58 may deploy tendrils. In another embodiment the head will not be set up to have deployable tendrils and only the housing 58 will have deployable tendrils. Such a column of deployed tendrils will make it more difficult for a swimmer or diver to dive below a single set of deployed tendrils. The housing 58 will house a plurality of tendril tubes 64 or barrels, containing coiled or otherwise stored tendrils (36 for example) that can be deployed from the housing 58. The tendril containing tubes 64 are housed inside a perimeter can 66 that includes apertures, one shown as 68, through which the tendrils can be launched from the tendril tubes 64. A manifold or chamber 70 will be pressurized by an explosive charge, a compressed air charge or other propulsion effect that will launch the tendrils. This operation is similar to the deployment of tendrils from the head 14 of the entangler as shown in the earlier figures in this application.

Figure 10:
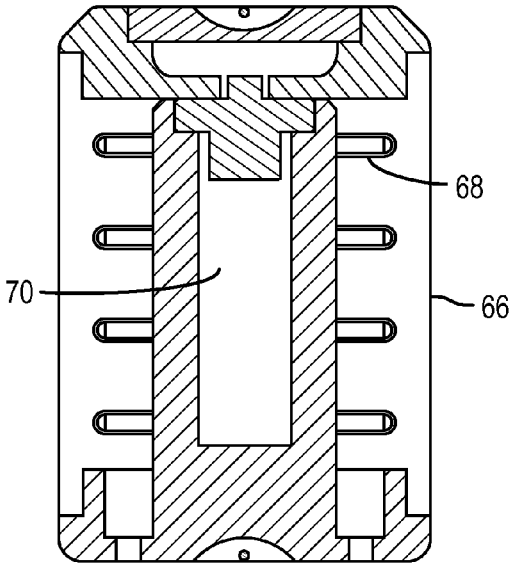
FIG. 10 is a cross-sectional view through plane 10-10 of FIG. 9.
Figure 11:
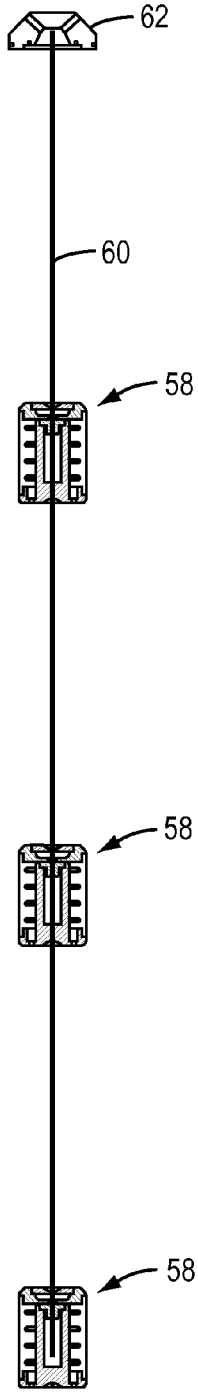
FIG. 11 is a representation of a plurality of containers for housing a plurality of entangling elements connected on a common tether attached to a head of an entangling device.
Figure 12:
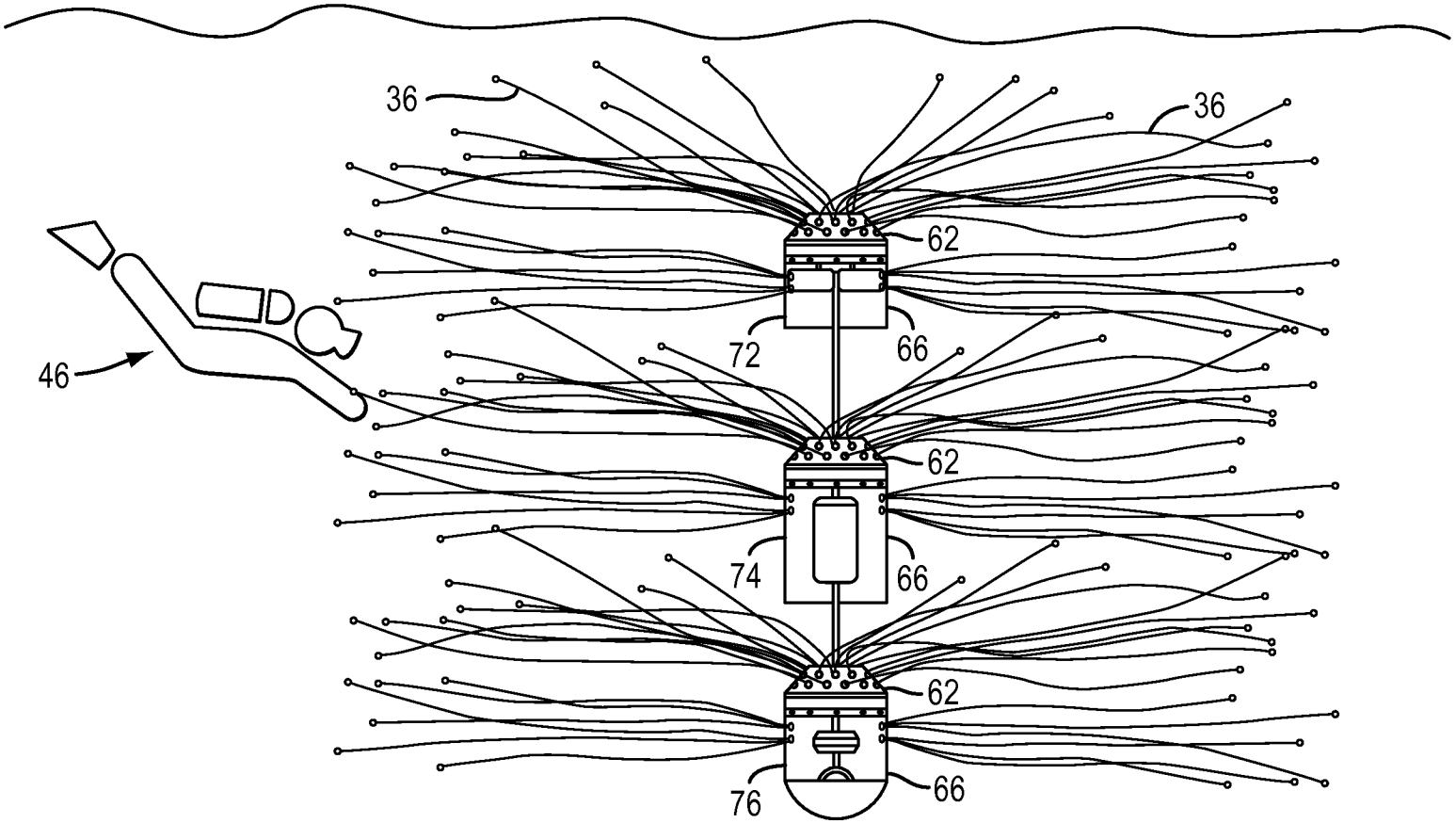
FIG. 12 is a pictorial representation of a swimmer or diver approaching an entangling device where entangling elements are deployed.

In FIG. 12, an alternative embodiment to the embodiment shown in FIG. 11, each of the strung together containers being a portion of the entangler shown in FIG. 6. In this embodiment there are three sections, a top portion 72, a central portion 74, and a lower portion 76. Each of these portions will include a head portion 62 capable of carrying and deploying tendrils as is disclosed above. Each of the three sections will also have the capability of deploying tendrils using a housing of the type shown in FIGS. 9 and 10. In this embodiment there may be fewer tendril tubes in each of the three housings. In this FIG. 12 embodiment, the tendrils, such as 36, and in this figure there are very many tendrils with an exemplary one shown as 36, are shown having been deployed from both the heads 72 and the housings 66 of the three separate housings of the device. This provides a column of tendrils, as would also be the result of deployment of the housings 58 in FIG. 9, which will make it difficult for a swimmer, diver, animal or fish to get through the column without contacting and getting entangled in the tendrils.

Figure 13:
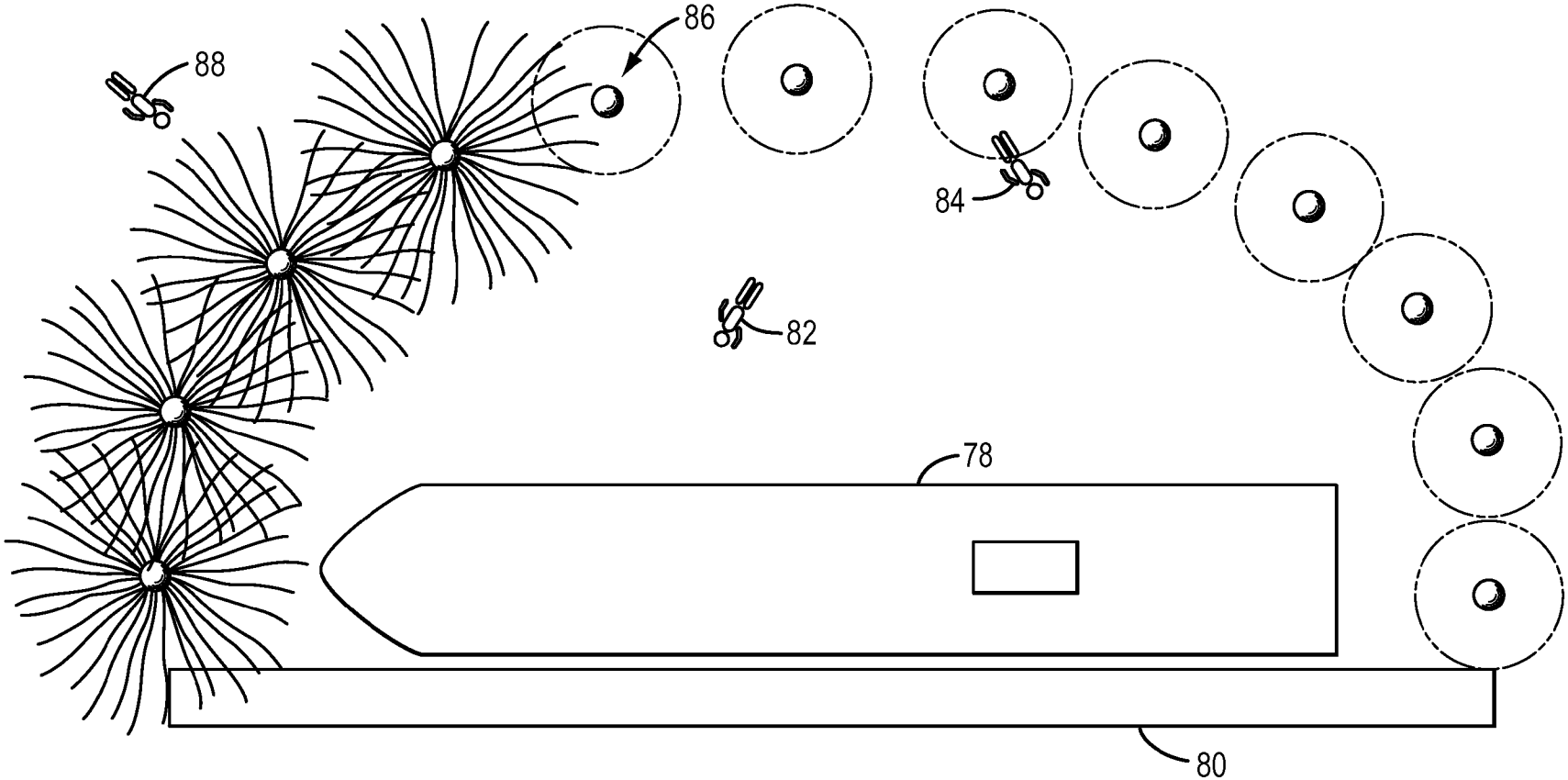
FIG. 13 is a schematic and pictorial representation, from above, of a plurality of entanglers deployed around a hull adjacent a dock.

FIG. 13 is a pictorial representation of how a plurality of entanglement devices could be positioned and deployed as necessary. In this situation there is a ship 78 to be protected from swimmers, divers and other water borne threats, docked to a dock 80. First and second "friendly" swimmers, 82 and 84 are patrolling the area generally inside the perimeter established by the entangler devices, one of twelve in this embodiment shown generally as 86. An "unfriendly" swimmer 88 is about to swim into an array of deployed entangler devices where a large number of tendrils will entangle the unfriendly swimmer. The four entanglers that have had the tendrils deployed may have been triggered to send the tendrils out by a switch triggered from an observer on the ship, a guard on the dock, the friendly swimmers or by a proximity detector associated with one or more of the entangling devices 86. This group of four or more or less entanglers could have been networked together to deploy tendrils at the same time. Similarly an entire group of entanglers can be networked together to operate simultaneously, sequentially, or individually and independently depending on the settings for that particular group of entanglers.

It should be pointed out that the tendrils, in one embodiment, would be invisible or nearly invisible to a swimmer or diver. The tendrils can be very thin, translucent or transparent and made to be very difficult to see, unless of course, there is intent to make the tendrils highly visible for deterrent or other reasons.

In another embodiment of the entangler it will be anchored to the seabed. Either the anchor or the buoyant housing, either location is contemplated by the inventor, as is an intermediate position between the anchor and the housing to locate a reel. The reel is an adjustable reel that can be remotely actuated to raise or lower the housing containing the tendril package above the seabed to a position at or below the surface of the water where the operator in charge of controlling the entangling device deems appropriate for perceived or actual threats.

The entangling devices can be deployed using any of the methods set forth in this disclosure. In a further embodiment the entangler device can be deployed, that is the tendrils can be deployed, by a pressure switch activated when the device is dropped into a body of water. Alternatively, the tendrils can be deployed by direct pressure of the surface of the water impacting the device as it contacts the water surface with sufficient velocity or acceleration to pressurize the manifold or housing that leads to the tendril tubes. When the device hits the water in the correct orientation, as designed into the housing, the water pressure acting directly on the manifold will "shoot" the tendrils out from the housing.

Figure 14:
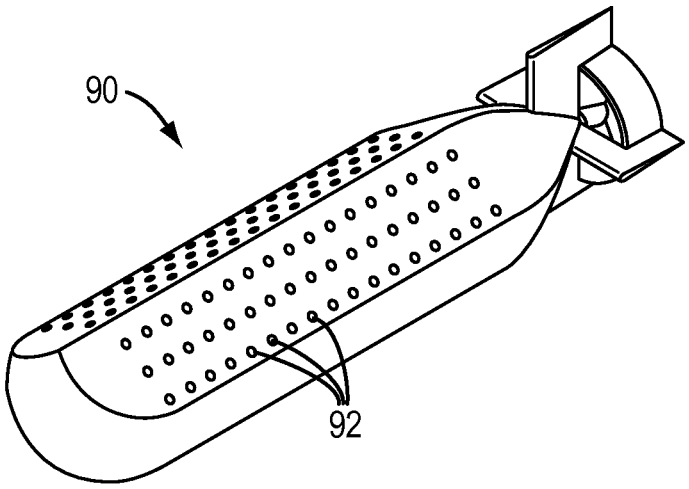
FIG. 14 is a subsurface delivery device for delivery of a plurality of restraint devices.
Figure 15:
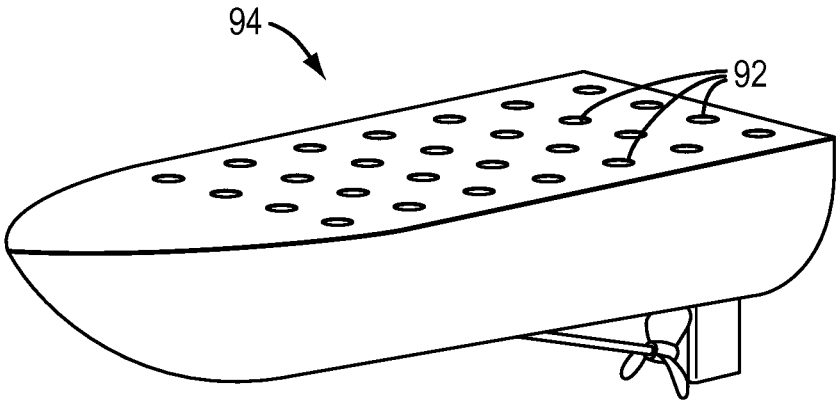
FIG. 15 is a surface delivery device for delivery of a plurality of restraint devices.

FIGS. 14 and 15 show two vessels that can be used to deliver the entanglers to an operations zone. In FIG. 14 a subsea self-propelled submarine, generally 90, is equipped with a plurality of launch tubes such as 92 in which the restraint devices are housed. Once the sub reaches a deployment station one or a plurality of restraint devices can be launched from the sub.

Similarly, in FIG. 15, a surface ship, generally 94, is also equipped with a plurality of launch tubes 92 for storing and delivering restraint devices.

In summary the apparatus of the invention presented here is an aquatic restraint device for use in an aquatic environment that comprises a housing having a tendril deployment head. The tendril deployment head has a pressure manifold inboard of the exterior surface of tendril deployment head. There is a barrel extending from the exterior of the tendril deployment head to the pressure manifold and a pressure source carried in the pressure manifold. In one embodiment there is a projectile carried in the barrel and a tendril connected to the projectile.

The restraint device may also include ballast of sufficient weight to completely submerge the apparatus in a body of water and be buoyant below the surface of the water or ballast of sufficient weight to partially submerge the apparatus in a body of water.

The pressure source is in communication with a switch for actuating an actuator that is capable of actuating the pressure source that is connected to a pressure manifold. The pressure manifold is in communication with a plurality of barrels extending from the exterior of the tendril deployment head inward to the pressure manifold. The pressure source is used to release pressure and launch the projectile carried in the barrel. Each of the plurality of barrels comprises a launch chamber.

In addition to simple tendrils a tendril may also comprise a filament capable of delivering an electric shock to a target.

In another embodiment of the invention the housing comprises a reel containing line and there is an anchor attached to the line of the reel whereby the amount of line between the reel and the anchor will determine the location of the housing at or below the surface of a body of water.

A still further embodiment may comprise an inflatable lift bag. It has also been found advantageous to provide a manually activated sensor capable of sensing a target in the restraint device. This sensor could be a passive sonar device, a laser device, a proximity sensor, or other similar sensing device that will sense the presence of a swimmer or diver near the restraint device.

The method used to entangle a swimmer or diver comprising the acts of providing an aquatic restraint device comprising a housing, a tendril deployment head, projectiles, and tendrils; sensing a target approaching the aquatic restraint device using a sensor; triggering activation of the aquatic restraint device upon the sensor sensing an approaching target; and launching the tendrils upon triggering of the aquatic restraint device. It can also include providing a plurality of aquatic restraint devices; setting up the plurality of aquatic restraint devices to communicate with each other to form a neural-net; sensing a target proximity to facilitate the location of the target; and communicating the location of the target to a central command.

Positioning of the device is accomplished, at least in part and after the device has been positioned in a body of water, by providing the aquatic restraint device with ballast; and regulating the ballast to float the aquatic restraint device to float partially above or below the surface of the water.

In one embodiment of the invention a plurality of restraint devices are "swarmed" toward and a round a target. This entails the acts of moving a plurality of aquatic restraint devices toward the target and positioning the aquatic restraint devices near the target, whereby the target is in close proximity to a plurality of aquatic restraint devices. The devices will require a propulsion system to move the aquatic restraint devices in the intended directions and a control system is provided to direct the direction of movement of the aquatic restraint device.

The tendrils, and the projectiles that are attached to the tendrils, intended to entangle a swimmer or diver may comprise buoyancy neutral tendrils attached to buoyancy neutral projectiles, positive buoyancy tendrils attached to positive buoyancy projectiles, or negative buoyancy tendrils attached to negative buoyancy projectiles that will either float on or below the surface of the body of water with the tendrils dispersed out around the aquatic restraint device.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

What is claimed is:

1. An aquatic non-lethal entanglement device, including tendrils, for deployment below the surface of a body of water, the restraint device for intercepting and entangling a target swimmer using the relative motion of the target swimmer and the tendrils to entangle the target swimmer swimming under the surface of the body of water when the tendrils are deployed, the entanglement device comprising:

a housing having a tendril deployment head, the tendril deployment head having a pressure manifold inboard of the exterior surface of the tendril deployment head;

a barrel extending from the exterior of the tendril deployment head to the pressure manifold;

a launchable spool having an elongated hollow body carried in the barrel of the tendril deployment head;

a pressure source carried in the pressure manifold;

a projectile carried on the launchable spool which is carried in the barrel of the tendril deployment head, the projectile having a hydro-dynamic shape;

at least one tendril for entangling the target swimmer carried on the launchable spool, the at least one tendril connected at one end thereof to the tendril deployment head and at a second end of the at least one tendril connected to the projectile;

a buoyancy bag to effect the buoyancy of the device, the buoyancy bag initially pressurized to float the entanglement device at a level below the surface of the body of water.

2. The invention in accordance with claim 1 wherein the non-lethal entanglement device is of sufficient weight to completely submerge the device below the surface of the body of water and the buoyancy bag is pressurized to float the entanglement device at a level below the surface of the body of water.

3. The invention in accordance to claim 1 wherein the target swimmer is a human being.

4. The invention in accordance with claim 1 wherein the target swimmer is an animal other than a human being.

5. The invention in accordance with claim 1 wherein the tendrils are buoyancy neutral.

6. The invention in accordance with claim 1 wherein the tendrils are buoyancy positive so that when deployed and with one end attached to the tendril deployment head the tendrils will float above the tendril deployment head.

7. The invention in accordance with claim 6 wherein the tendrils disperse around the tendril deployment head when the tendrils are deployed.

* * * * *